US006530471B1

(12) United States Patent
Tsuyuguchi

(10) Patent No.: US 6,530,471 B1
(45) Date of Patent: Mar. 11, 2003

(54) STORAGE BAG

(75) Inventor: Kenichi Tsuyuguchi, Kagawa (JP)

(73) Assignee: Best Products Co., Ltd, Kagawa (JP)

( * ) Notice: Subject to any disclaimer, the term of this patent is extended or adjusted under 35 U.S.C. 154(b) by 0 days.

(21) Appl. No.: 09/642,692

(22) Filed: Aug. 22, 2000

(30) Foreign Application Priority Data

Aug. 25, 1999 (JP) ..... 11-006446

(51) Int. Cl.[7] ..... B65D 81/26
(52) U.S. Cl. ..... 206/204; 426/124; 493/189
(58) Field of Search ..... 206/204; 426/124, 426/129; 493/189; 383/113

(56) References Cited

U.S. PATENT DOCUMENTS 3,209,978 A * 10/1965 Dupuis ..... 206/205
3,889,870 A * 6/1975 Bender ..... 383/121
4,275,811 A * 6/1981 Miller ..... 206/204
4,321,997 A * 3/1982 Miller ..... 206/204
4,742,908 A * 5/1988 Thomas, Jr. et al. ..... 206/204
4,756,939 A * 7/1988 Goodwin ..... 428/74
4,815,590 A * 3/1989 Peppiatt et al. ..... 206/204
4,940,621 A * 7/1990 Rhodes et al. ..... 428/137
5,055,332 A * 10/1991 Rhodes et al. ..... 428/74
5,176,930 A * 1/1993 Kannakeril et al. ..... 426/124
5,552,169 A * 9/1996 Kannakeril et al. ..... 426/107
5,599,763 A * 2/1997 Harada et al. ..... 502/402
5,672,633 A * 9/1997 Brehm et al. ..... 521/53
5,845,769 A * 12/1998 Yeager ..... 206/204

* cited by examiner

*Primary Examiner*—Mickey Yu
*Assistant Examiner*—Troy Arnold
(74) *Attorney, Agent, or Firm*—Wenderoth, Lind & Ponack, L.L.P.

(57) ABSTRACT

A storage bag comprising a sealable bag of a liquid and gas impermeable sheet material and a liquid absorbing sheet contained therein, said liquid absorbing sheet being set in said sealable bag with a covering sheet preventing meat or fish from directly contacting with said liquid absorbing sheet. Said liquid absorbing sheet may comprise liquid absorbing polymer powder and liquid permeable sheets sandwiching said polymer powder therebetween and being packed with the covering sheet and the backing sheet forming a package absorbing insert.

22 Claims, 4 Drawing Sheets

STORAGE BAG

BACKGROUND OF THE INVENTION

1. Field of the Invention

The present invention relates to the improvement of bags for packing and storing meat and fish, and more specifically to provide such storage bags contained a liquid absorbing sheet for absorbing extra juice exuding therefrom.

2. Prior Arts

Storage bags for packing and storing meat and fish are preferred to contain a liquid absorbing sheet for absorbing extra juice exuding therefrom. If this is not the case, meat and fish are dipped in the juice exuding therefrom and the dipped portion of said meat and fish is discolored and deteriorates.

Accordingly there have been provided storage bags containing a liquid absorbing sheet for absorbing juice exuding therefrom. However, inserting a liquid absorbing sheet into each of storage bags were troublesome, and there have been provided storage bags having a liquid absorbing sheet inserted during manufacturing storage bags.

However, meat or fish inserted in said storage bags directly contacted with said liquid absorbing sheet and not only extra juice exuding from meat or fish but also juice retained in meat or fish are absorbed into said liquid absorbing sheet. Such overabsorption of juice dried meat or fish and quality deterioration was observed.

SUMMARY OF THE INVENTION

It is therefore an object of the present invention to provide storage bags containing a liquid absorbing sheet for absorbing extra juice exuding from meat or fish while preventing meat or fish from directly contacting said liquid absorbing sheet.

Another object of the invention is to provide storage bags containing a liquid absorbing sheet wherein said liquid absorbing sheet is secured in the storage bags during manufacturing the storage bags without damaging liquid absorbing properties and meat or fish can be easily inserted without being obstructed by said liquid absorbing sheet.

In order to achieve the above object, the present invention provides a storage bag comprising a sealable bag of a liquid and gas impermeable sheet material and a liquid absorbing sheet contained therein, said liquid absorbing sheet being set in said sealable bag with a covering sheet preventing meat or fish from directly contacting with said liquid absorbing sheet.

Said covering sheet may be made of a liquid permeable film such as a perforated film or comprises an upper liquid permeable layer such as a liquid permeable nonwoven fabric or liquid permeable film and a lower liquid impermeable layer such as liquid impermeable film or liquid repellent nonwoven fabric. Further said covering sheet may comprise an upper liquid permeable layer such as a liquid permeable nonwoven fabric or liquid permeable film such as perforated film and a lower liquid permeable layer such as perforated film or mesh sheet.

Extra juice exuding from meat or fish can be absorbed into the liquid absorbing sheet through the covering sheet made of a liquid permeable film or through the upper liquid permeable layer of the coverring sheet or through the upper liquid permeable layer and the lower liquid permeable layer.

The present invention also provides a storage bag comprising a sealable bag of a liquid and gas impermeable sheet material, a liquid absorbing sheet contained therein, a covering sheet made of liquid impermeable material preventing meat or fish from directly contacting with said liquid absorbing sheet and a backing layer of liquid permeable material through which juice is absorbed into the liquid absorbing sheet. Extra juice exuding from meat or fish can be absorbed into the liquid absorbing sheet passing through the backing layer of liquid permeable material. Said backing layer may be liquid permeable nonwoven fabric and the like.

The liquid absorbing sheet may be made of liquid absorbing polymer powder, liquid absorbing polymer fibers, liquid absorbing paper, liquid absorbing pulp fibers, liquid absorbing nonwoven fabric or may comprise liquid absorbing polymer powder and liquid permeable sheets sandwiching the liquid absorbing polymer powder therebetween. A complex structure may be also applicable. Namely the liquid absorbing sheet may be a complex structure comprising any optional combination of polymer powder, liquid permeable sheets sandwiching polymer powder therebetween, polymer fibers, liquid absorbing paper, pulp fibers and liquid absorbing nonwoven fabric.

Further provided in the present invention is a storage bag comprising a sealable bag of liquid and gas impermeable sheet material, a liquid absorbing sheet contained therein, a covering sheet made of liquid impermeable material preventing meat or fish from directly contacting with said liquid absorbing sheet and a backing sheet of liquid permeable material through which juice is absorbed into the liquid absorbing sheet, said sealable bag comprising front and rear liquid and gas impermeable sheets, said liquid absorbing sheet comprising liquid absorbing polymer powder and liquid permeable sheets sandwiching said polymer powder therebetween and being packed with the covering sheet and the backing sheet forming a package absorbing insert, and said package absorbing insert being secured in the sealable bag by heat sealing side edges together with side edges of the sealable bag and a rear edge of said package absorbing insert being free from the front and rear sheets of the sealable bag and a front edge of said package absorbing insert being heat bonded at several points to the rear sheet of the sealable bag for enabling easy insertion of meat or fish and enabling juice to reach the backing sheet through the spacing between the several bonded points. The covering sheet made of liquid impermeable material may be liquid impermeable film or liquid repellent nonwoven fabric. Said covering sheet may have pores all over the sheet or at a part of the sheet, as far as juice to be retained in meat or fish is not absorbed by the liquid absorbing sheet.

A sealable bag of liquid and gas impermeable sheet material may be heat sealed after inserting meat or fish and producing a vacuum. Occasionally a sealable bag may be sealed by detachably attachable zipper profiles provided at the bag opening.

A nonwoven fabric may be attached to all over the inner surface of the front sheet of the sealable bag for preventing meat or fish from discoloring due to the contact with the inner surface of the front sheet.

DETAILED DESCRIPTION OF THE INVENTION

Figure 1:
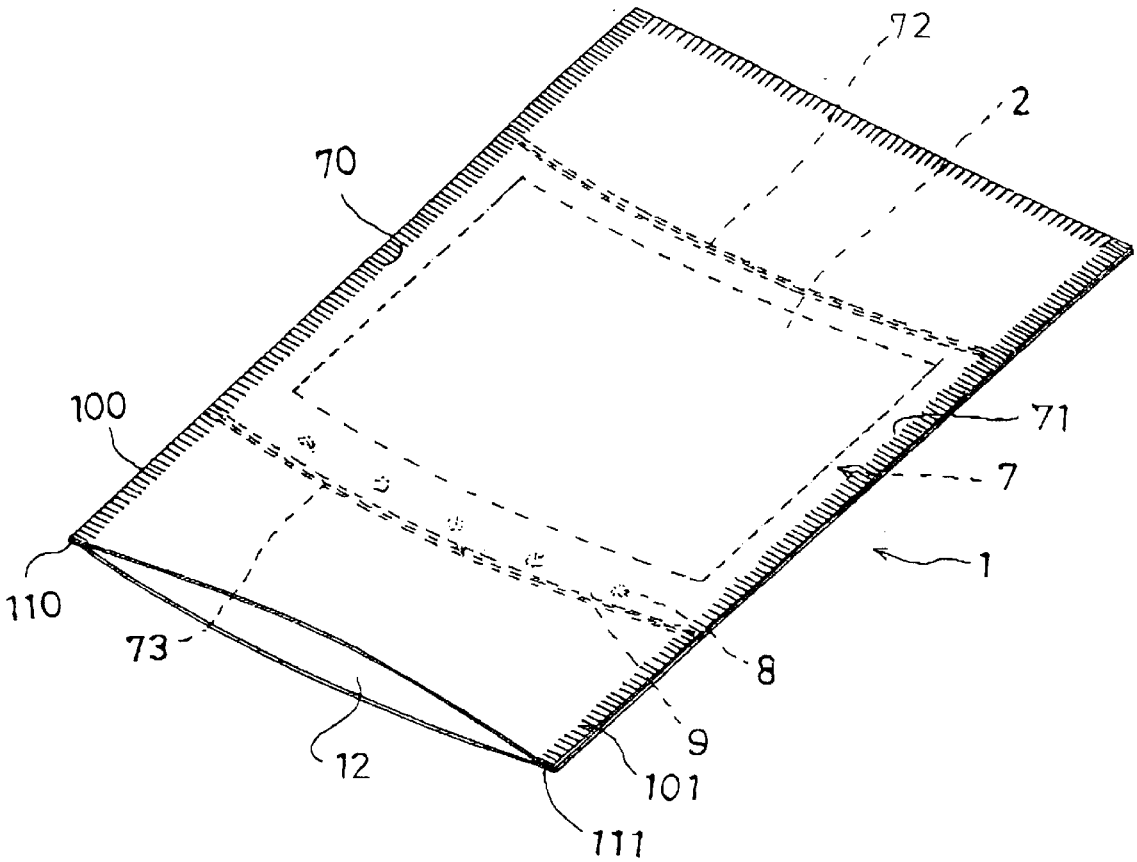
FIG. 1 is a perspective view showing a preferable embodiment of a storage bag in accordance with the present invention.
Figure 2:
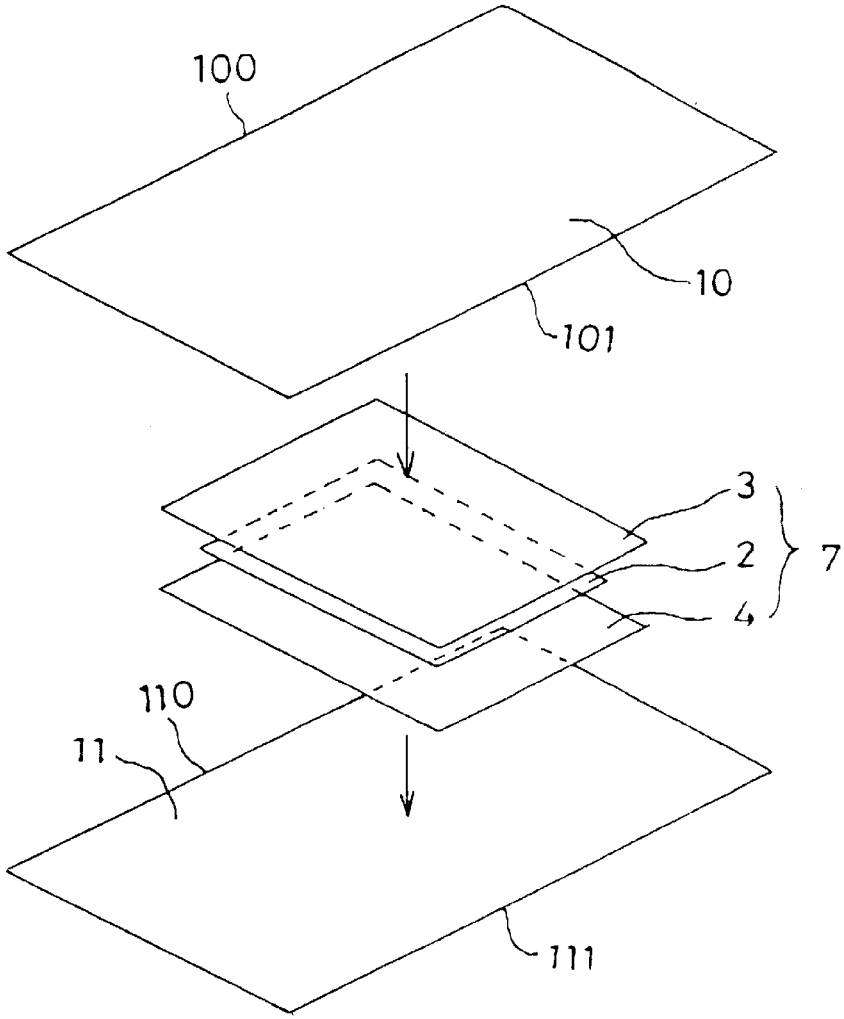
FIG. 2 is a perspective view showing each part of the structure of the embodiment shown in FIG. 1.
Figure 3:
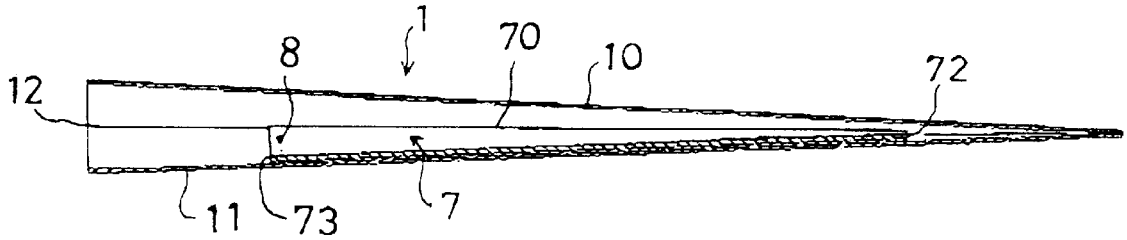
FIG. 3 is a cross sectional view of the embodiment shown in FIG. 1.
Figure 4:
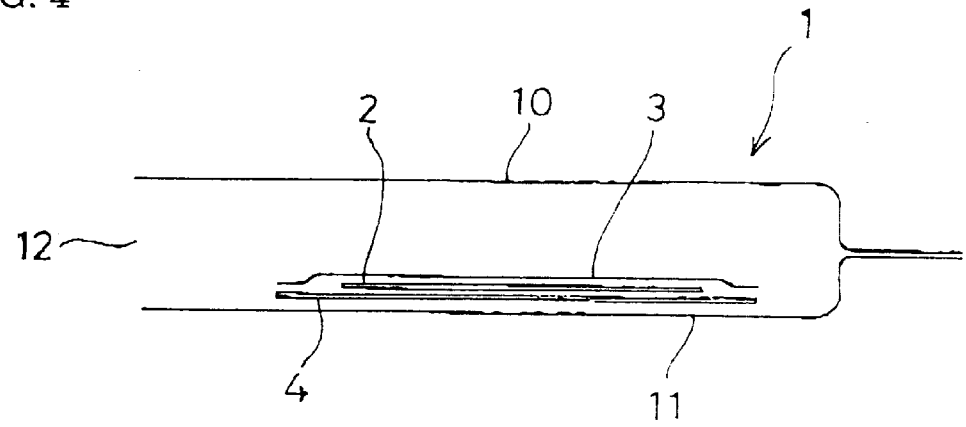
FIG. 4 is a diagrammatic illustration of the structure of the embodiment shown in FIG. 1.

The present invention will now be described referring to the drawings.

Figure 5:
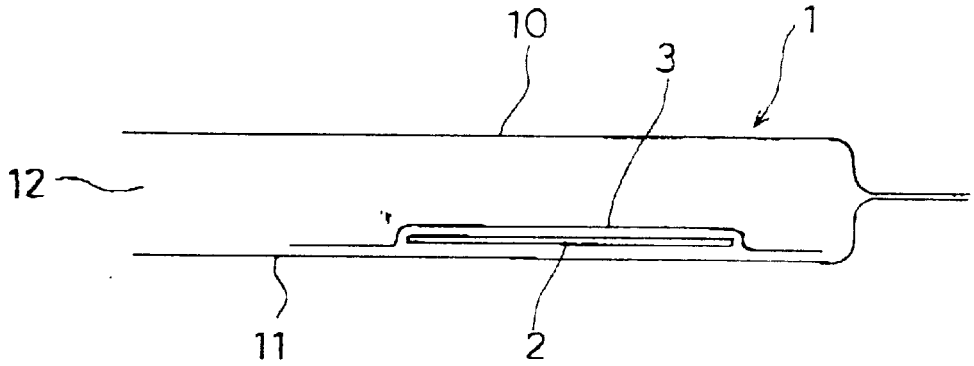
FIG. 5 is a diagrammatic illustration of the structure of an alternate embodiment of the present invention.
Figure 7:
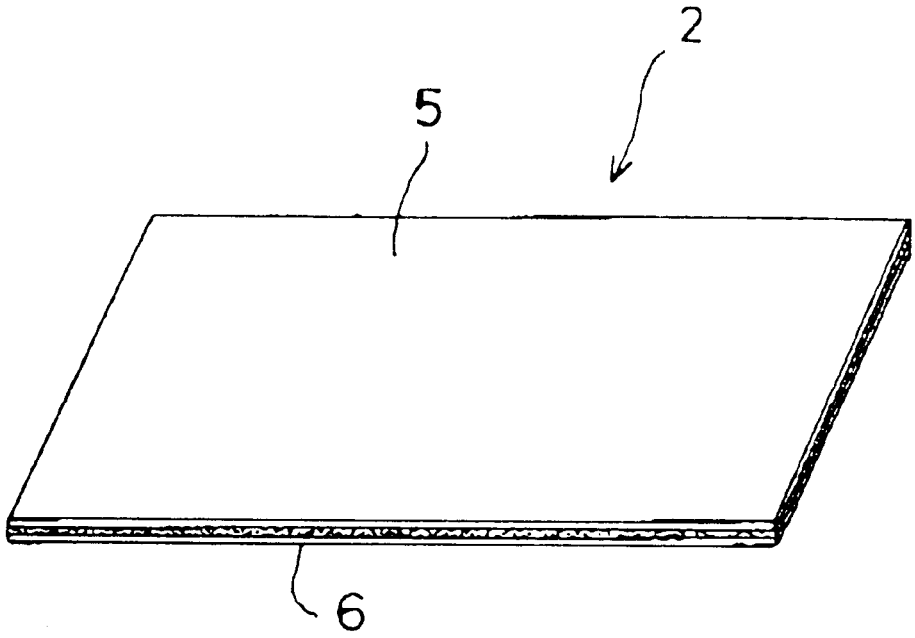
FIG. 7 is a diagrammatic illustration of one embodiment of the liquid absorbing sheet in accordance with the present invention.

FIG. 5 illustrates a diagrammatic view of one embodiment of a storage bag in accordance with the present invention which comprises a sealable bag 1 of a liquid and gas impermeable sheet material and a liquid absorbing sheet 2 contained therein, said liquid absorbing sheet 2 being set in said sealable bag 1 with a covering sheet 3 preventing meat or fish from directly contacting with said liquid absorbing sheet 2. Said covering sheet is made of a liquid permeable film such as a perforated film. Extra juice exuding from meat or fish can be absorbed into the liquid absorbing sheet 2 through the covering sheet 3 made of a liquid permeable film. The liquid absorbing sheet 2 may be made of liquid absorbing polymer powder, liquid absorbing polymer fibers, liquid absorbing paper, liquid absorbing pulp fibers, liquid absorbing nonwoven fabric or may comprise liquid absorbing polymer powder and liquid permeable sheets 5, 6 sandwiching the liquid absorbing polymer powder therebetween as shown in FIG. 7. A complex structure may be also applicable. Namely the liquid absorbing sheet 2 may be a complex structure comprising any optional combination of polymer powder, liquid permeable sheets 5, 6 sandwiching polymer powder therebetween, polymer fibers, liquid absorbing paper, pulp fibers and liquid absorbing nonwoven fabric.

Figure 6:
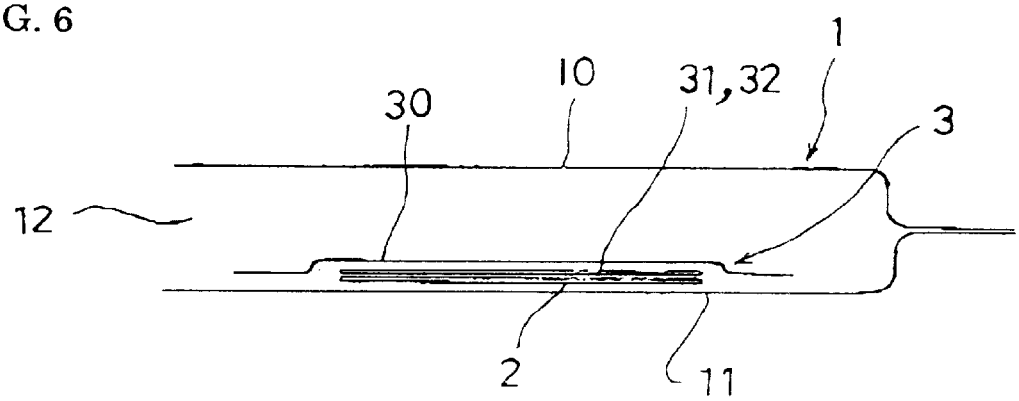
FIG. 6 is a diagrammatic illustration of the structure of a further alternate embodiment of the present invention.

FIG. 6 illustrates a diagrammatic view of an alternate embodiment of a storage bag in accordance with the present invention which comprises a sealable bag 1 of a liquid and gas impermeable sheet material and a liquid absorbing sheet 2 contained therein, said liquid absorbing sheet 2 being set in said sealable bag 1 with a covering sheet 3 preventing meat or fish from directly contacting with said liquid absorbing sheet 2. Said covering sheet 3 comprises an upper liquid permeable layer 30 such as a liquid permeable nonwoven fabric or liquid permeable film such as perforated film and a lower liquid impermeable layer 31 such as liquid impermeable film or liquid repellent nonwoven fabric. Further said covering sheet 3 may comprise an upper liquid permeable layer 30 and a lower liquid permeable layer 32 such as perforated film or mesh sheet. Extra juice exuding from meat or fish can be absorbed into the liquid absorbing sheet 2 through the upper liquid permeable layer 30 of the covering sheet 3 or through the upper liquid permeable layer 30 and the lower liquid permeable layer 32. The liquid absorbing sheet 2 may be made of liquid absorbing polymer powder, liquid absorbing polymer fibers, liquid absorbing paper, liquid absorbing pulp fibers, liquid absorbing nonwoven fabric or may comprise liquid absorbing polymer powder and liquid permeable sheets 5, 6 sandwiching the liquid absorbing polymer powder therebetween as shown in FIG. 7. A complex structure may be also applicable. Namely the liquid absorbing sheet 2 may be a complex structure comprising any optional combination of polymer powder, liquid permeable sheets 5, 6 sandwiching polymer powder therebetween, polymer fibers, liquid absorbing paper, pulp fibers and liquid absorbing nonwoven fabric.

Through FIG. 1 to FIG. 4 a preferable embodiment of the storage bag in accordance with the present invention is disclosed. A storage bag comprises a sealable bag 1 of liquid and gas impermeable sheet material, a liquid absorbing sheet 2 contained therein, a covering sheet 3 made of liquid impermeable material preventing meat from directly contacting with said liquid absorbing sheet 2 and a backing sheet 4 of liquid permeable material through which meat juice is absorbed into the liquid absorbing sheet 2, said sealable bag 1 comprising a front sheet 10 and a rear sheet 11 both of a liquid and gas impermeable sheet, said liquid absorbing sheet 2 comprising liquid absorbing polymer powder and liquid permeable sheets 5, 6 sandwiching said polymer powder therebetween and being packed with the covering sheet 3 and the backing sheet 4 forming a package absorbing insert 7, and said package absorbing insert 7 being secured in the sealable bag 1 by heat sealing side edges 70, 71 together with side edges of the sealable bag 1, namely side edges 100 and 101 of the front sheet 10 and side edges 110 and 111 of the rear sheet 11, and a rear edge 72 of said package absorbing insert 7 being free from the front and rear sheets 10, 11 of the sealable bag 1 and a front edge 73 of said package absorbing insert 7 being heat bonded at several points 8 to the rear sheet 11 of the sealable bag 1 for enabling easy insertion of meat or fish and enabling juice to reach the backing sheet 4 through the spacing 9 between the several bonded points 8. Extra juice exuding from meat or fish can be absorbed into the liquid absorbing sheet 2 through the backing sheet 4 and the liquid permeable sheet 6. Said package absorbing insert 7 can be secured in the sealable bag during manufacturing the storage bags. As the rear edge 72 of said package absorbing insert 7 is free from the front and rear sheets 10, 11 of the sealable bag 1 and the front edge 73 of said package absorbing insert 7 is heat bonded at several points 8 remaining the spacing 9 therebetween to the rear sheet 11 of the sealable bag 1, extra juice exuding from meat or fish can be easily absorbed into the liquid absorbing sheet 2. As the front edge 73 of said package absorbing insert 7 is heat bonded at several points 8, meat or fish can be easily inserted without being obstructed by said liquid absorbing sheet 2 or the package absorbing insert 7.

The sealable bag of liquid and gas impermeable sheet material illustrated and described above may be heat sealed after inserting meat or fish and producing a vacuum. Occasionally the sealable bag may be sealed by detachably attachable zipper profiles provided at the bag opening 12.

It is to be understood that the invention is not to be limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A storage bag comprising:

a sealable bag of a liquid and gas impermeable material, said sealable bag having an upper surface and a lower surface; and a package absorbing insert in said sealable bag, said package absorbing insert having side edges, a front edge and a rear edge, and including (i) a liquid absorbing sheet, (ii) a covering sheet of liquid impermeable material positioned over said liquid absorbing sheet for preventing meat or fish from directly contacting said liquid absorbing sheet, and (iii) a backing sheet of liquid permeable material positioned under said liquid absorbing sheet for allowing liquid of the meat or fish to be absorbed by said liquid absorbing sheet through said backing sheet, wherein said front edge of said package absorbing insert is attached to said lower surface of said sealable bag by being bonded thereto at plural spaced points such that the liquid of the meat or fish can flow through the space between the plural spaced points, and wherein at least one of said side edges and said rear edge is not attached to any one of said upper surface and said lower surface of said sealable bag.

2. The storage bag according to claim 1, wherein said rear edge of said package absorbing insert is not attached to any one of said upper surface and said lower surface of said sealable bag.

3. The storage bag according to claim 2, wherein said side edges of said package absorbing insert are each attached to said upper surface and said lower surface of said sealable bag.

4. The storage bag according to claim 3, wherein said sealable bag comprises a top sheet of the liquid and gas impermeable material defining said upper surface of said sealable bag and a bottom sheet of the gas and liquid impermeable material defining said bottom surface of said sealable bag, said top sheet and said bottom sheet each having side edges, and wherein said side edges of said package absorbing insert are attached to said upper surface and said lower surface of said sealable bag by being respectively heat sealed between said side edges of said top sheet and said bottom sheet.

5. The storage bag according to claim 4, wherein said liquid absorbing sheet comprises a liquid absorbing polymer powder sandwiched between liquid permeable sheets.

6. A storage bag comprising:

a sealable bag of a liquid and gas impermeable material, said sealable bag having an upper surface and a lower surface; and a package absorbing insert in said sealable bag, said package absorbing insert having side edges, a front edge and a rear edge, and including (i) a liquid absorbing sheet, (ii) a covering sheet of liquid impermeable material positioned over said liquid absorbing sheet for preventing meat or fish from directly contacting said liquid absorbing sheet, and (iii) a backing sheet of liquid permeable material positioned under said liquid absorbing sheet for allowing liquid of the meat or fish to be absorbed by said liquid absorbing sheet through said backing sheet, wherein at least said front edge of said package absorbing insert is attached to said lower surface of said sealable bag, and at least one of said side edges and said rear edge is not attached to any one of said upper surface and said lower surface of said sealable bag, and wherein said side edges of said package absorbing insert are each attached to said upper surface and said lower surface of said sealable bag.

7. The storage bag according to claim 6, wherein said sealable bag comprises a top sheet of the liquid and gas impermeable material defining said upper surface of said sealable bag and a bottom sheet of the gas and liquid impermeable material defining said bottom surface of said sealable bag, said top sheet and said bottom sheet each having side edges, and wherein said side edges of said package absorbing insert are attached to said upper surface and said lower surface of said sealable bag by being respectively heat sealed between said side edges of said top sheet and said bottom sheet.

8. The storage bag according to claim 6, wherein said liquid absorbing sheet comprises a liquid absorbing polymer powder sandwiched between liquid permeable sheets.

9. The storage bag according to claim 1, wherein said liquid absorbing sheet comprises a liquid absorbing polymer powder sandwiched between liquid permeable sheets.

10. The storage bag according to claim 1, wherein said liquid absorbing sheet comprises liquid absorbing polymer powder.

11. The storage bag according to claim 1, wherein said liquid absorbing sheet comprises liquid absorbing polymer fibers.

12. The storage bag according to claim 1, wherein said liquid absorbing sheet comprises liquid absorbing paper.

13. The storage bag according to claim 1, wherein said liquid absorbing sheet comprises pulp fibers.

14. The storage bag according to claim 1, wherein said liquid absorbing sheet comprises a liquid absorbing non-woven fabric.

15. The storage bag according to claim 1, wherein said liquid absorbing sheet comprises a complex sheet including a combination of at least two of polymer powder, polymer fibers, liquid absorbing paper, pulp fibers, liquid absorbing non-woven fabric and polymer powder sandwiched between liquid permeable sheets.

16. The storage bag according to claim 6, wherein said liquid absorbing sheet comprises a liquid absorbing polymer powder sandwiched between liquid permeable sheets.

17. The storage bag according to claim 1, wherein said liquid absorbing sheet comprises liquid absorbing polymer powder.

18. The storage bag according to claim 1, wherein said liquid absorbing sheet comprises liquid absorbing polymer fibers.

19. The storage bag according to claim 1, wherein said liquid absorbing sheet comprises liquid absorbing paper.

20. The storage bag according to claim 1, wherein said liquid absorbing sheet comprises pulp fibers.

21. The storage bag according to claim 1, wherein said liquid absorbing sheet comprises a liquid absorbing non-woven fabric.

22. The storage bag according to claim 1, wherein said liquid absorbing sheet comprises a complex sheet including a combination of at least two of polymer powder, polymer fibers, liquid absorbing paper, pulp fibers, liquid absorbing non-woven fabric and polymer powder sandwiched between liquid permeable sheets.

* * * * *